United States Patent [19]

Trudel

[11] 3,962,847

[45] June 15, 1976

[54] COIN WRAPPING DEVICE

[76] Inventor: Roger Trudel, 1616 First Ave., Val Caron, Ontario, Canada, P0M 3A0

[22] Filed: Mar. 31, 1975

[21] Appl. No.: 563,636

[52] U.S. Cl. ..... 53/212; 53/213
[51] Int. Cl.[2] ..... B65B 11/04; B65B 49/00
[58] Field of Search ..... 53/213, 212, 211, 204, 53/390

[56] References Cited

UNITED STATES PATENTS

| | | | |
|---|---|---|---|
| 1,287,303 | 12/1918 | Heer | 53/213 X |
| 1,466,633 | 8/1923 | Strom | 53/211 |
| 2,163,509 | 6/1939 | Bagley et al. | 53/213 |
| 2,637,960 | 5/1953 | Powers | 53/213 |

*Primary Examiner*—Travis S. McGehee
*Assistant Examiner*—Horace M. Culver
*Attorney, Agent, or Firm*—W. Irwin Hakett

[57] ABSTRACT

A coin wrapping device to assure the simple safe stacking and firm and secure wrapping of a roll of coins of selected common diameter having a housing incorporating an elongated cylindrical chamber including an arcuate trough of appropriate diameter and an arcuate hinged cover therefor, a manually rotatable shaft in the cover parallel with the chamber and a resilient friction roller on the shaft with part of its circumference projecting through an aperture in the cover into the chamber in spaced relation to said trough. The housing for the coin wrapping chamber is mounted on a base that provides also a flat work surface for preliminary folding of an end of a conventional paper wrapper prior to introducing the same to the wrapping chamber.

8 Claims, 4 Drawing Figures

COIN WRAPPING DEVICE

This invention relates to improvements in a coin wrapping device and appertains particularly to a manually operable apparatus for packaging a stack of coins of a common diameter in a secure paper-enclosed roll.

BACKGROUND OF THE INVENTION:

With the massive increase in the volume of coins minted and their rate of circulation accelerated by the growing use of coin-operated vending machines, the time and effort involved in handling them has become a serious concern for many businesses.

Various racks and rollers have been designed to measure and stack and/or roll coins of selected diameter or denomination to a desired total value but these are not entirely satisfactory as the coin stacks not infrequently spill nor are the wrapped rolls uniformly firm and secure and sometimes fall apart.

Accordingly, it is an object of this invention to provide an improved device for stacking and wrapping rolls of coins of a common diameter and denomination.

A further object of the invention is to provide a coin wrapping device that assures the safe stacking and firm and secure wrapping of a roll of coins.

A still further object is the provision of a coin wrapping device that is simple and positive in operation that it may be used with confidence by a handicapped person.

A still further object is the provision of a device of the nature and for the purpose specified that is of stable design, sturdy and durable construction and reliable and assured operation.

To the accomplishment of these and related objects as shall become apparent as the description proceeds, the invention resides in the construction, combination and arrangement of parts as shall be hereinafter more fully described, illustrated in the accompanying drawings and pointed out in the claims hereunto appended.

BRIEF DESCRIPTION OF THE DRAWINGS

The invention will be best understood and can be more clearly described when reference is had to the drawings forming a part of this disclosure wherein like characters indicate like parts throughout the several views.

In the drawings.

DETAILED DESCRIPTION OF THE PREFERRED EMBODIMENT

In the present invention an open trough of appropriate diameter and length arranged at an incline provides a receptacle for a stack of a counted number of coins of one denomination arranged on edge with an underlying paper wrapper and the coin stack and wrapper are then rotated by a manually operated roller that is hinged over the paper nested coin stack to frictionally engage the upper side thereof.

Figure 1:
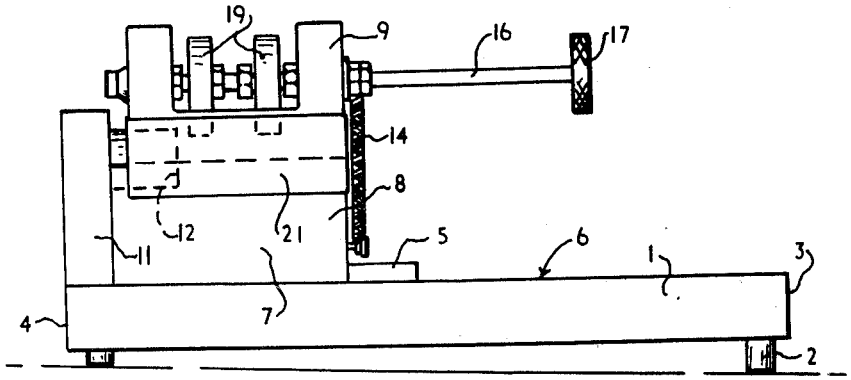
FIG. 1 is a side elevation of a preferred embodiment of the coin wrapping device.
Figure 2:
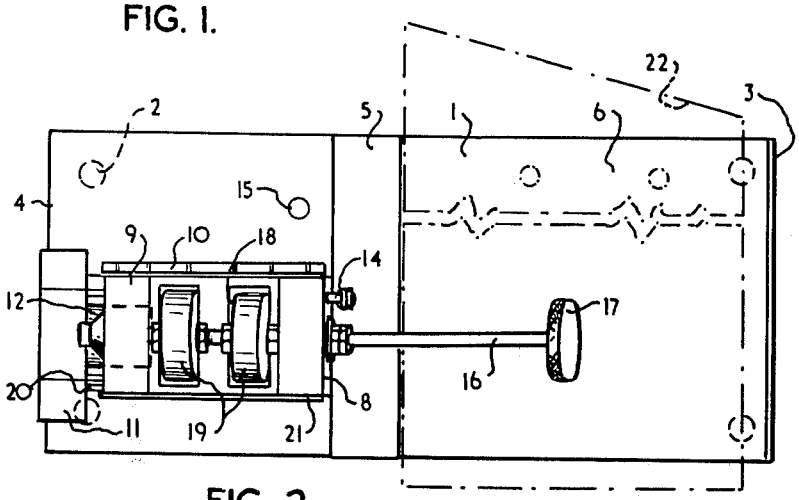
FIG. 2 is a plan view thereof.

With particular reference to the illustrated embodiment, an elongated rectangular base 1 is mounted at an incline on rubber feet 2 that are taller at upper end 3, i.e. the right hand end, than at the lower or left hand end 4, as viewed in FIGS. 1 and 2. A raised member such as the plate 5 extends transversely of the base intermediate the ends thereof and at right angles to the opposite sides of the base. The top of the base between the plate 5 and the upper end 3 of the base provides a flat work surface 6 which will be referred to later.

Between the transverse plate 5 and the lower end 4 of the base 1, the operative coin wrapping mechanism is mounted consisting of a housing 7 that incorporates an elongated cylindrical chamber extending in the direction of the elongated rectangular base being split horizontally into an arcuate trough 8 and a complementary arcuate cover 9 connected to the trough by a hinge 10 along the rear side. The cylinder follows the incline of the base 1, and has its upper end open and the lower end closed by wall 11. A coin stop 12 in the form of a circular boss 12 is mounted on the end wall 11 being of smaller diameter than the cylinder and extending concentrically into the lower end thereof.

Figure 3:
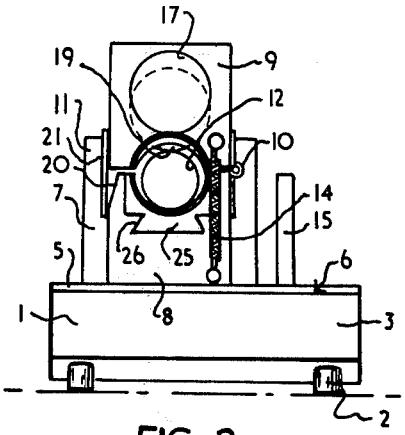
FIG. 3 is an end view as seen from the right of FIG. 1.

A tension spring 14 biased between the trough 8 and hinged cover 9 of housing 7 normally holds the cover in closed position as seen in FIGS. 1, 2 and 3, or exerts pressure on it in that direction if a roll of coins in the trough prevents it from closing completely. In open position, the spring 14 holds cover 9 on the arresting post 15 rising from base 1 along side housing 7.

Figure 4:
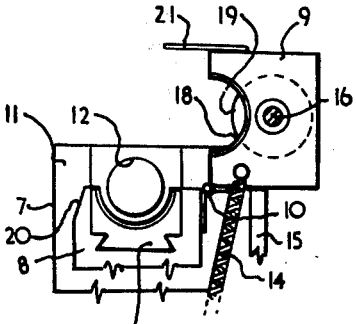
FIG. 4 is a detail sectional elevation of the same end, on the true axis of the cylindrical chamber and with the hinged cover in open position.

A manually rotatable shaft 16 is suitably journalled in the cover 9, as in raised ends thereof, having its axis paralleling that of the cylindrical chamber, and with one end extending out over the flat work surface 6 of the base and terminally provided with a knurled knob 17. Between the ends of the hinged cover 9, one or more apertures or open hatchways 18 are provided affording access to the cylindrical chamber and through such aperture or apertures, a corresponding number of friction rollers 19 fixed on shaft 16 extend so that the lower arc or part of their circumference projects into the cylindrical chamber in confronting and spaced relation to the trough 8, as will be seen on reference to FIGS. 3 and 4.

Designating the hinge side of the housing 7 as the "far" side, according to FIG. 1, the near or open side of the trough 8 has its upper edge 20 bevelled and the near or free side of cover 9 has a laterally disposed plate 21 running therealong that depends as a lip to overlie the outside bevelled edge 20 of the trough in loose or spaced relation when the cover is in closed position.

To wrap a number of coins, say forty 25 cent pieces in a $10.00 roll, a sheet of paper of conventional coin wrapper design indicated in dot-dash outline at 22 in FIG. 2 having parallel sides, one square end and one angled end is placed on the flat work surface 6 of the base 1 as shown, with one edge against the raised transverse plate 5 and about one-quarter of an inch of the square end projecting over the near side of the base 1, which end is folded down and creased. With cover 9 opened, the creased wrapper 22 is inserted in the trough 8 with the creased end straddling the near bevelled edge 20 and the inner side of the wrapper is slipped toward the lower end of the trough to underlie the intruding concentric boss 12. The selected coins are then deposited on the paper in the trough, standing on edge in a side-by-side position from the boss 12, outwardly toward the upper open end of the trough. On closing the hinged cover, the paper wrapper is rounded down over the top of the coins, with its free angled end issuing from under the loose cover lip 21. At this time the friction rollers 19 under the weight of cover 9 and action of spring 14 are bearing on the curled paper wrapper as it passes over the roll of coins, so as the knurled knob 17 is rotated counter-clockwise, as indicated by arrows in FIGS. 1, 2 and 3, the paper enveloped coin roll is caused to rotate clockwise with the creased, doubled back end of the wrapper leading as the inner convolution of tightly rolled package. It is to be noted that the torque of shaft 16 further increases pressure of the friction rollers on the coin roll. When the rolling is completed, the cylindrical housing cover is opened, the outer end of the paper wrapper is crimped in, the snugly tight package is withdrawn longitudinally from the trough and the inner end of the paper wrapper is crimped thereby providing a firm and securely wrapped roll of coins.

This coin wrapping mechanism is useable with coins of different diameter. For this purpose the trough portion 8 of the cylinder housing is formed as a removable part as by having a dove-tail base 25 slidable longitudinally in a complementary groove 26 in said housing, the aligned part of the housing end 11 and the concentric boss 12 being preferably formed integral with and as a related part of the removable trough unit. If smaller diameter coins such as 10 cent pieces are to be rolled, the arc of the trough in a replacement slide unit will be of smaller diameter, the boss will also be smaller in diameter but still concentric and duly spaced from the trough to accommodate the paper wrapper. The depth of the slide part in troughs of smaller diameter will be increased to raise the top of the roll of coins to proper level to be acted on by the friction rollers. The length of the boss will also vary as required to center the stack of coins relative to the width of the paper wrapper. Accordingly, a set of such replaceable troughs is provided as required as each size of coin may have its particular trough unit.

The efficiency of the wrapping mechanism is increased by assuring that the fixed parts of the trough 8, boss 12 and related areas that are engaged by the moving paper wrapper 22 have a low co-efficient of friction and also that the rollers 19 possess a degree of resiliency that enhances their gripping action on the winding roll or package and compensate for some variation in the diameter of the coins.

It is understood that various changes in the size, shape and arrangement of parts may be made to the form of invention herein shown and described, without departing from the spirit of the invention or scope of the claims.

What is claimed is:

1. A coin wrapping device comprising a housing incorporating an elongated cylindrical chamber including an arcuate trough and a complementary hinged cover; a manually rotatable shaft mounted in said cover parallel with said chamber; and a friction roller on said shaft with part of its circumference projecting into said chamber in spaced relation to said trough.

2. A coin wrapping device according to claim 1, wherein said elongated cylindrical chamber is disposed at an incline, with the upper end of the inclined chamber being open, and a coin stop of smaller diameter than the chamber cylinder extends concentrically into the lower end thereof.

3. A coin wrapping device according to claim 2, wherein the cylindrical chamber housing is mounted on an elongated rectangular base near one end thereof, a flat work surface being provided at the opposite end of said base, and a raised member extends transversely of said base between said housing and said work surface.

4. A coin wrapping device according to claim 3 wherein said cylindrical chamber housing runs longitudinally of the base with its open end facing the work surface of the base and said shaft projects over said work surface and is terminally provided with a knob.

5. A coin wrapping device according to claim 1 having a tension spring biased between the trough and complementary hinged cover of said housing.

6. The coin wrapping device according to claim 1 having a plate disposed laterally along the free side of said hinged cover depending therefrom to overlie the side of the trough when the cover is in closed position and wherein such side of said trough is bevelled along its upper edge.

7. The coin wrapping device according to claim 1 wherein the arcuate trough of said housing is formed as a separate part, being slidably removable longitudinally of the housing.

8. The coin wrapping device according to claim 2 wherein the arcuate trough and concentric coin stop are formed as a separate unit in longitudinally sliding relation to the housing and removable from the lower end thereof.

* * * * *